US006321414B1

(12) United States Patent
Buchanan et al.

(10) Patent No.: US 6,321,414 B1
(45) Date of Patent: Nov. 27, 2001

(54) HINGE FOR ELECTRICAL ENCLOSURE

(75) Inventors: Jeffery J. Buchanan, Lexington; Edward A. Hyatt, Lawrenceburg, both of KY (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/470,403

(22) Filed: Dec. 22, 1999

(51) Int. Cl.[7] ..... E05D 7/10
(52) U.S. Cl. ..... 16/257
(58) Field of Search ..... 16/257, 254, 262, 16/263, 271, 261; 312/223.2, 327; 220/836, 840

(56) References Cited

U.S. PATENT DOCUMENTS 2,898,991 * 8/1959 Kelly et al. ..... 16/257
3,641,623 * 2/1972 Weiss ..... 16/257
3,689,115 * 9/1972 Andreini et al. ..... 16/257
3,728,758 * 4/1973 Johansen ..... 16/257
4,863,062 * 9/1989 Holliday ..... 16/257
5,381,920 * 1/1995 Lin ..... 16/261
5,557,828 * 9/1996 Reiner et al. ..... 16/257

* cited by examiner

*Primary Examiner*—Chuck Y. Mah
(74) *Attorney, Agent, or Firm*—David R. Stacey; Larry T. Shrout; Larry I. Golden

(57) ABSTRACT

A snap-in hinge for an enclosure having provisions to prevent binding of the attached cover. The hinge includes at least two legs extending from the ends of a curved portion of the hinge and a blocking means integral with the corresponding hinge slot located in the enclosure. The legs, extending from the ends of the hinge, provide a smooth and continuous bearing surface for the enclosure cover, thereby preventing the enclosure cover from being trapped under an extended portion of the hinge which might be used to prevent over insertion of the hinge into the hinge slot. The blocking means of the corresponding hinge slot engaging parallel edges of the curved portion on the hinge prevents the hinge from being over inserted into the slot and thereby binding on the portion of the enclosure cover captivated by the curved portion of the hinge.

20 Claims, 6 Drawing Sheets

HINGE FOR ELECTRICAL ENCLOSURE

FIELD OF THE INVENTION

The present invention relates to electrical enclosures, such as service entrance panels, and particularly to cover hinges.

BACKGROUND OF THE INVENTION

It is common to employ hinged covers on electrical enclosures. Many types of hinges have been employed. Some are welded on, some are screwed on, some require bending of tabs after installation and some simply snap into place. Obviously, snap-in hinges require much less time to install than the other choices and therefore add less cost to the electrical enclosure. Snap-in hinges, however, require some features not required by the other hinge types. Snap-in hinges are generally U-shaped, having a curved portion and two extending spaced-apart legs. The legs are pushed into a hinge slot located in the electrical enclosure or a deadfront attached to the enclosure. The hinge slot is dimensioned to snugly receive the two extending legs of the hinge. The cover being attached to the enclosure also has a slot for each hinge. The cover slots are located along an edge of the cover such that a narrow web (generally equivalent to a hinge pin) is formed between the edge of the cover and the slot. When the hinge is installed, this web is captured between the curved portion of the hinge and the enclosure. Snap-in or push-in hinges require some type of captivating means to prevent the hinge from being unintentionally removed after it is installed. It has been common practice to provide an outwardly extending projection in each leg to captivate the hinge in the hinge slot. Snap-in hinges also require some type of over insertion stop to prevent over insertion during assembly or resulting from rough handling during shipping. Over insertion of the hinge can bind the cover web between the hinge and the enclosure, causing it to be difficult to open. One commonly used over insertion stop is accomplished by extending of the curved portion of the hinge slightly past the extending legs such that the curved portion cannot pass through the hinge slot in the enclosure. Snap-in or push-in hinges are generally made from brass or thin spring steel (0.020 in. thick). During an impact event, such as being dropped, the cover can abruptly slide with respect to the enclosure, thus cutting into a brass hinge or causing the thin, hardened edge of a spring steel hinge to cut into the cover. It is also possible for a portion of the cover adjacent the cover slot to slide under the extended curved portion of the hinge (over insertion stop). This entrapment of a portion of the cover will prevent the cover from rotating freely on the hinge. Examples of snap-in and bent tab hinges as described above can be found in U.S. Pat. No. 5,557,828.

SUMMARY OF THE INVENTION

The snap-in hinge of the present invention incorporates a spring captivating means that has an increasing resistance to the forces that cause unintentional removal. Further, the hinge of the present invention, in combination with the hinge slot configuration, provides a positive stop for preventing over insertion of the hinge without requiring features that can entrap a portion of the cover. The design of the captivating means is such that the hinge can be made from spring steel of sufficient thickness to significantly limit cutting of the cover during an impact event due to the increase in contact surface area.

Figure 1:
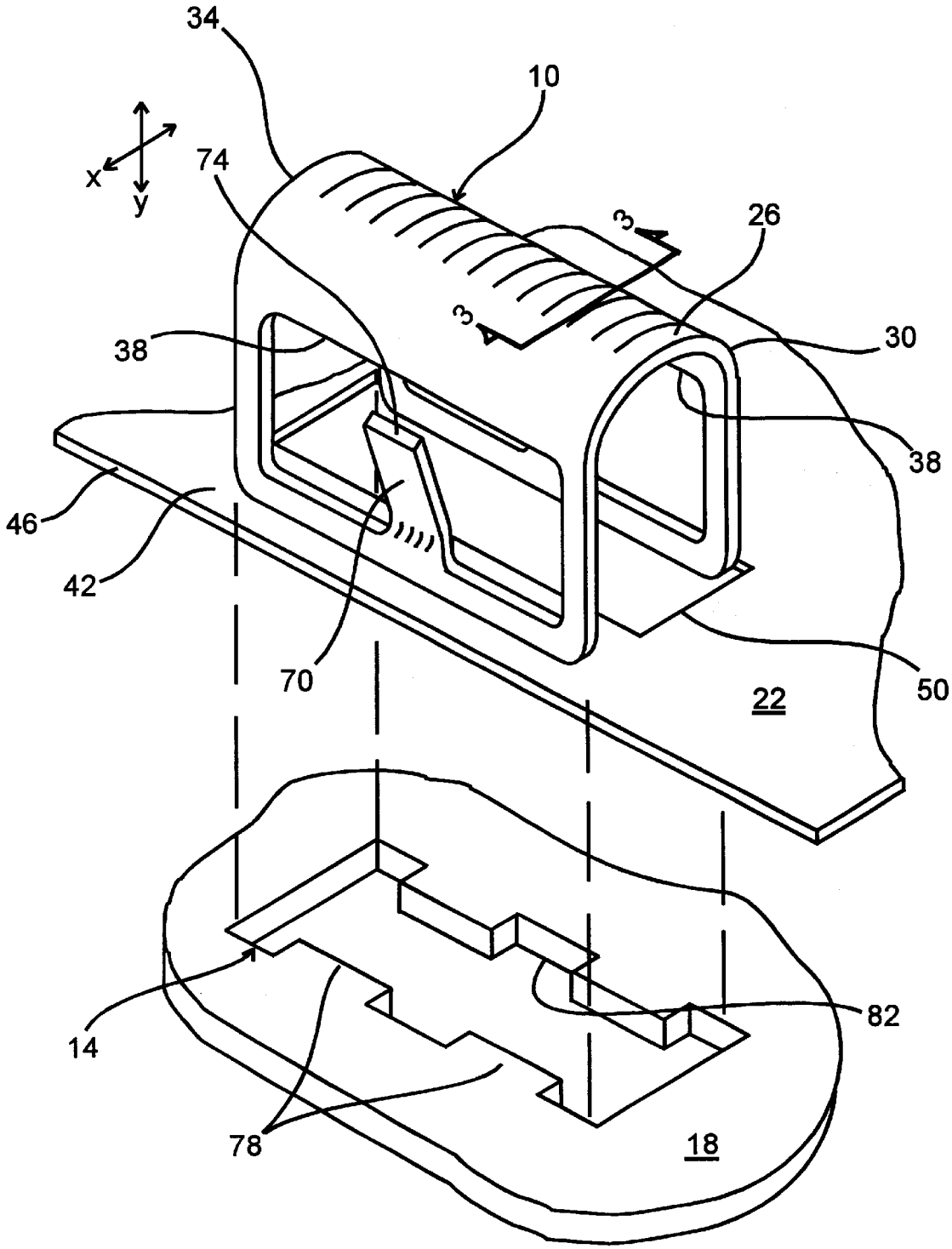
FIG. 1 illustrates a first embodiment of a hinge and corresponding hinge slot constructed in accordance with the present invention.

Before one embodiment of the invention is explained in detail, it is to be understood that the invention is not limited in its application to the details of construction described herein or as illustrated in the drawings. The invention is capable of other embodiments and of being practiced or being ended out in various other ways. Further, it is to be understood that the phraseology and terminology used herein is for the purpose of description and should not be regarded as limiting.

DETAILED DESCRIPTION OF THE DRAWINGS

FIG. 1 illustrates in exploded view a first embodiment of a snap-in hinge generally indicated by reference numeral 10, a corresponding hinge slot 14 defined in an enclosure 18, the hinge 10 and corresponding hinge slot 14 being constructed in accordance with the present invention, and an enclosure cover 22. The hinge 10 is made of spring steel and includes a generally curved portion 26 defined by a first end 30, a second end 34 parallel to the first end 30, and two generally parallel edges 38 generally connecting the first and second ends, 30 and 34, respectively. The curved portion 26 captures a web 42 (equivalent to a hinge pin) formed in the enclosure cover 22. The web 42 is formed between an edge 46 of the enclosure cover 22 and a slot 50 adjacent the edge 46.

Figure 2:
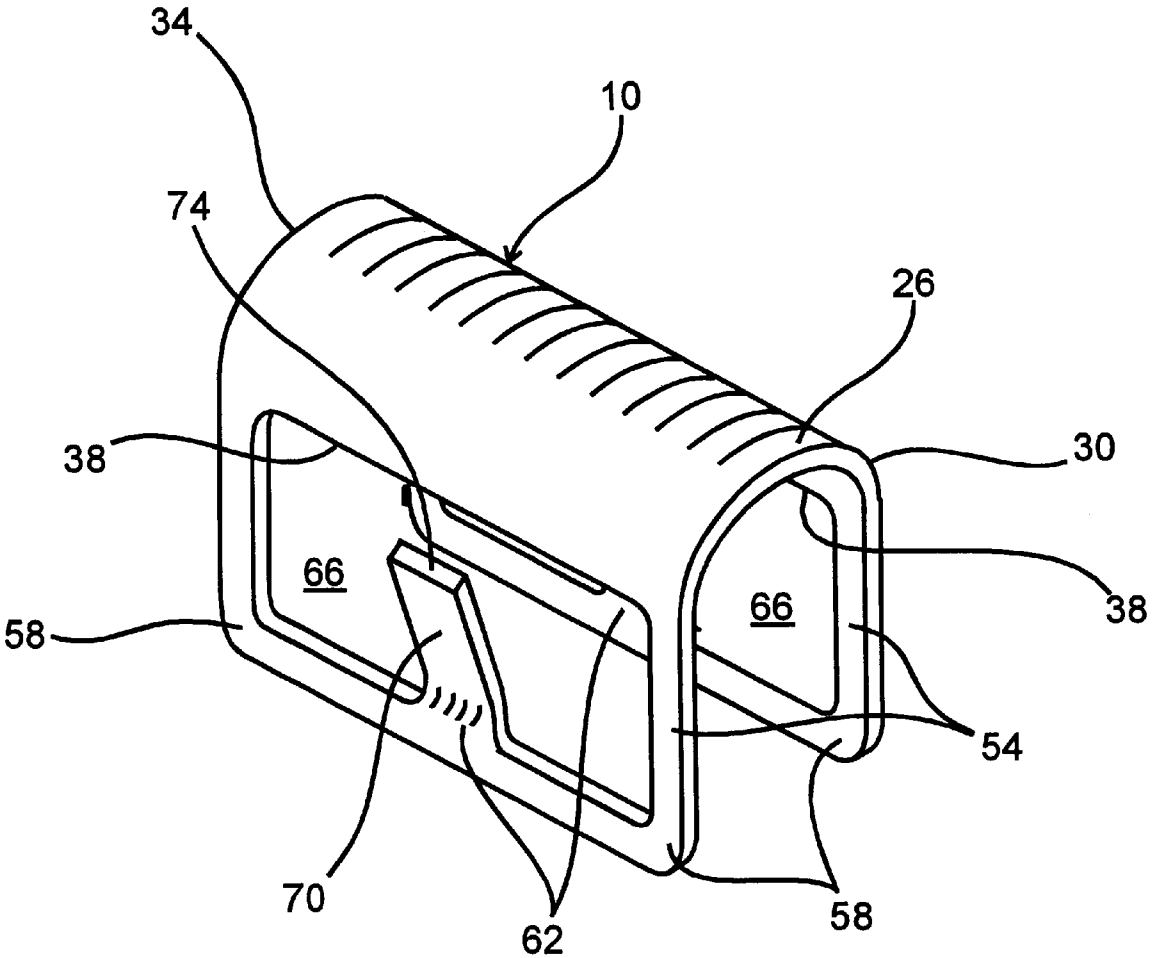
FIG. 2 is an isometric view of the snap-in hinge of FIG. 1.

Referring now to FIG. 2, an isometric view of the hinge 10, it can be seen that a leg 54 extends generally perpendicularly from each of two parallel edges 38 at the intersection of the first and second ends, 30 and 34, respectively, thus providing a smooth and continuous bearing surface for the enclosure cover 18. Each leg 54 is generally tangential to the curved portion 26. The two legs 54 extending from a common edge 38 are generally parallel to one another and are connected at their distal ends 58 by a rail 62 generally parallel to the common edge 38. The rail 62, common edge 38 and two legs 54 define a generally rectangular window 66 in which the spring steel material of the hinge 10 has been removed. The legs 54 flex or bend along or just below the edges 38 during insertion of the hinge 10 into the corresponding hinge slot 14. Therefore, removing the spring steel material in the window 66 reduces the overall cross-section of the hinge 10 and permits the use of a thicker spring steel material without increasing the force required to install the hinge 10 in the corresponding hinge slot 14. The thicker spring steel material reduces the chance of the hinge 10 cutting into the enclosure cover 22 by providing a wider surface (greater cross-section) to abut the material of the cover 22 at the slot 50 (FIG. 1). A captivating means 70, integrally formed from the rail 62 extends into the window 66 toward the common edge 38 and at a slight outward angle with respect to a common edge 38 such that an engaging end 74 of the captivating means 70 is spaced apart slightly from the common edge 38 in both the X and Y dimensions as indicated in FIG. 1.

Referring again to FIG. 1, it can be seen that the corresponding hinge slot 14 is generally rectangular in shape, having an overall length and width dimensioned to slidably receive the legs 34 extending from the hinge 10. The corresponding hinge slot 14 includes blocking tabs 78 which extend slightly into the corresponding hinge slot 14 such as to engage the two parallel edges 38 of the curved portion 26, thus preventing the hinge 10 from being inserted too far into the corresponding hinge slot 14. The blocking tabs 78 are positioned along the sides of the corresponding hinge slot 14 such as to engage the two parallel edges 78 on either side of the captivating means 70.

Figure 3:
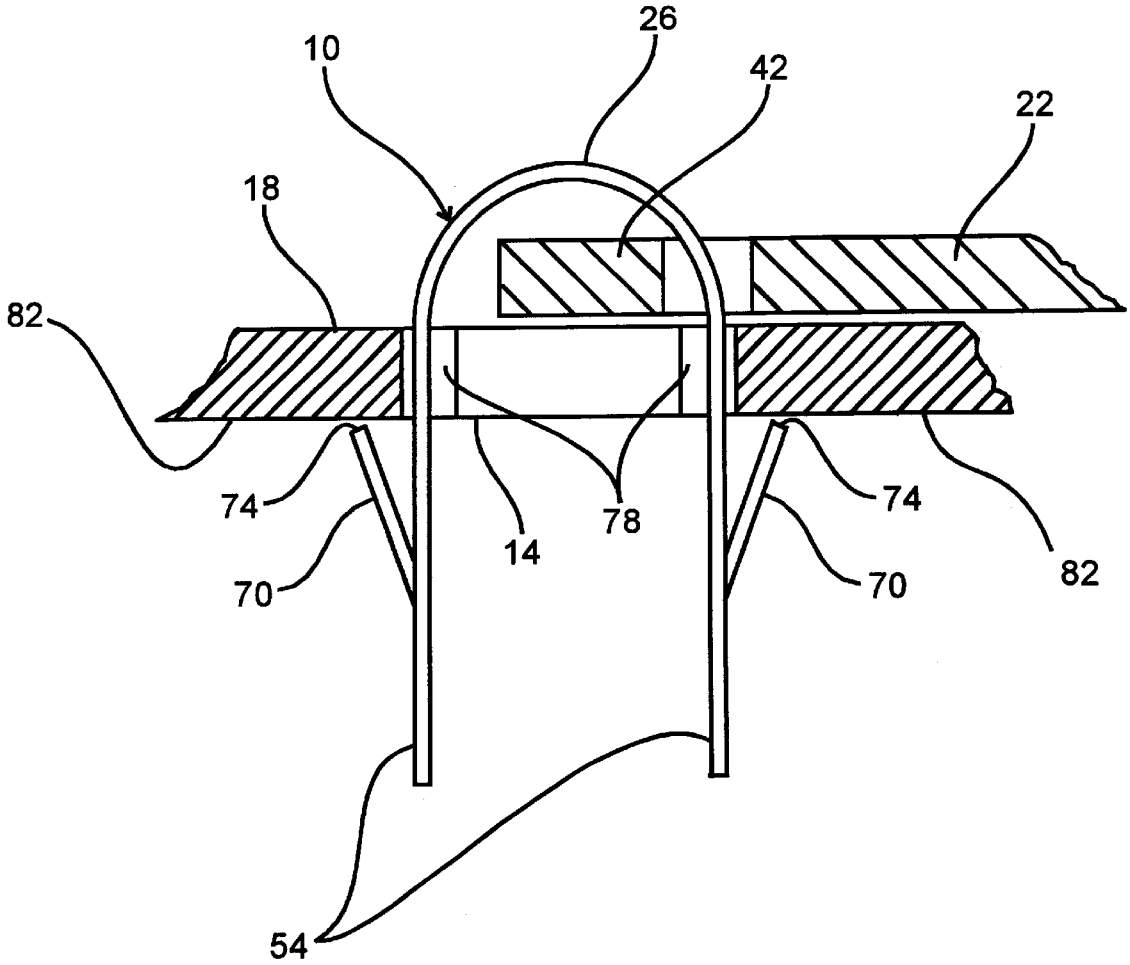
FIG. 3 is a cross-sectional view taken along line 3—3 of FIG. 1 wherein the hinge is installed in the corresponding hinge slot.

FIG. 3 illustrates in cross-section, the relationship of the hinge 10 with respect to the corresponding hinge slot 14 in the enclosure 18 and the web 42 of the enclosure cover 22. The web 42 of the enclosure cover 22 is rotatably captured within the curved portion 26 of the hinge 10. The blocking tabs 78 of the corresponding hinge slot 14 engage the two parallel edges 38 to prevent over insertion of the hinge 10 into the corresponding hinge slot 14. The distal end 74 of the captivating means 70 is positioned to engage an inside surface 82 of the enclosure 18 to prevent unintentional removal of the hinge 10.

Figure 4:
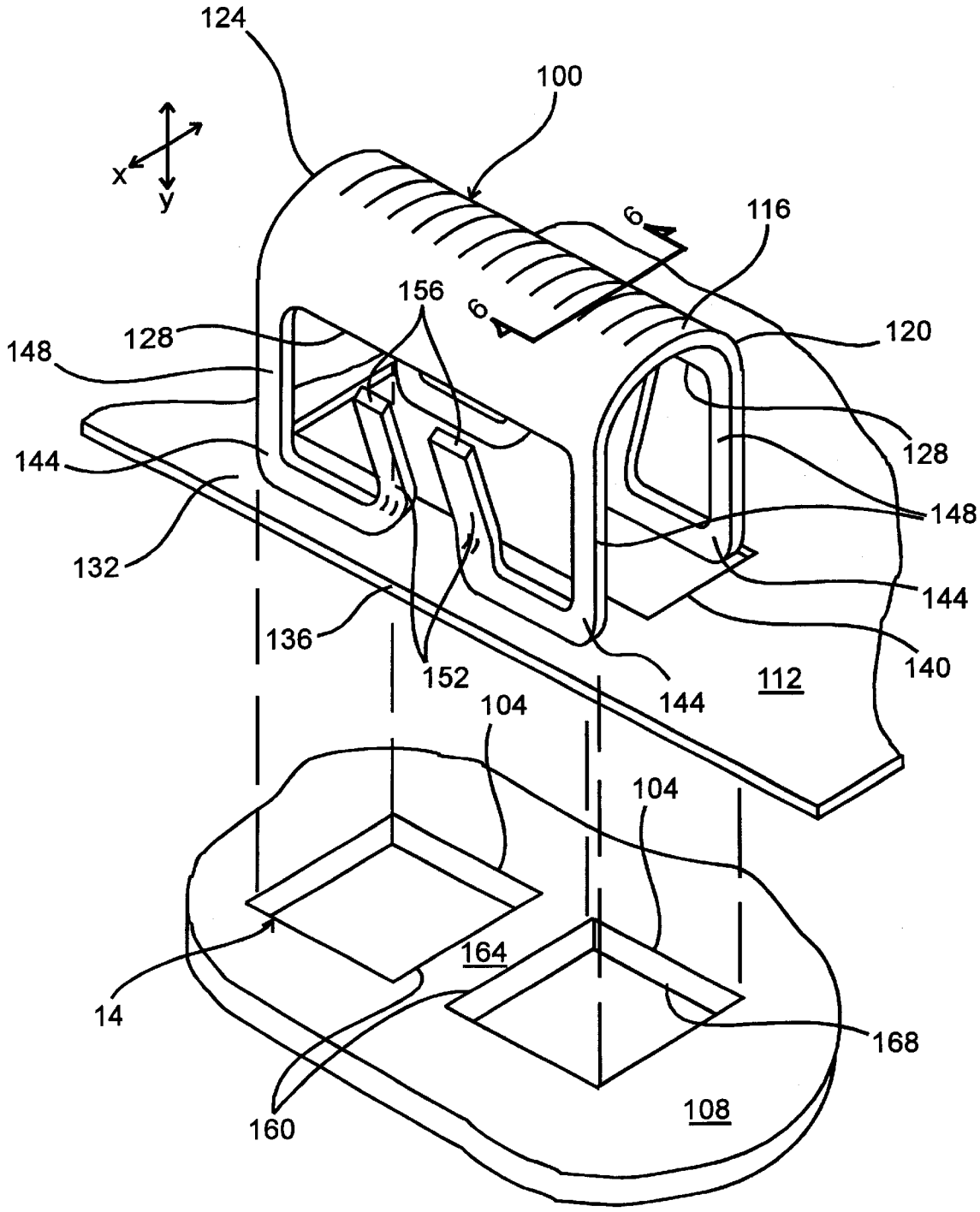
FIG. 4 illustrates a second embodiment of a hinge and corresponding hinge slot constructed in accordance with the present invention.

Referring now to FIG. 4, a second embodiment of a snap-in hinge generally indicated by reference numeral 100, a corresponding hinge slot 104 defined in an enclosure 108, the hinge 100 and corresponding hinge slot 104 being constructed in accordance with the present invention, and an enclosure cover 112 are illustrated in exploded view. As in the previous embodiment, the hinge 100 is made of spring steel and includes a generally curved portion 116 defined by a first end 120, a second end 124 parallel to the first end 120, and two generally parallel edges 128 generally connecting the first and second ends, 120 and 124, respectively. The curved portion 116 captures a web 132 (equivalent to a hinge pin) formed in the enclosure cover 112. The web 132 is formed between an edge 136 of the enclosure cover 112 and a slot 140 adjacent the edge 136.

Figure 5:
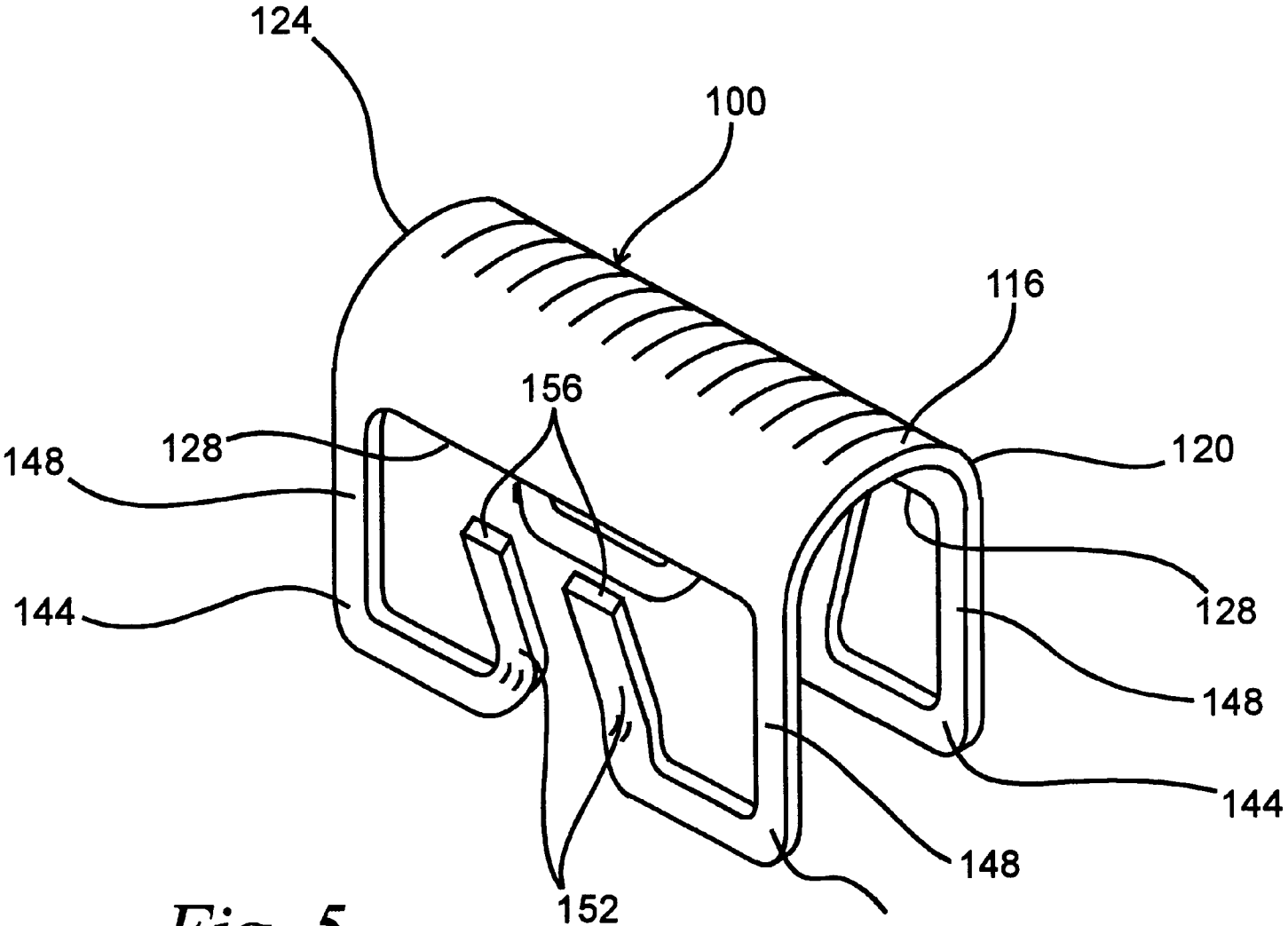
FIG. 5 is an isometric view of the snap-in hinge of FIG. 4.

Referring now to FIG. 5, an isometric view of the hinge 100, it can be seen that a generally U-shaped leg 144 extends generally perpendicularly from each of the two parallel edges 128 at the intersection of the first and second ends, 120 and 124, respectively, thus providing a smooth and continuous bearing surface for the enclosure cover 112. A portion 148 of each leg 144 connecting to the edge 128 of the hinge 100 is generally tangential to the curved portion 116 of the hinge 100. The unattached portion 152 of each leg 144 is at a slight outward angle with respect to its associated edge 128 such that a distal end 156 is spaced apart from its associated edge 128 in both the X and Y dimensions as indicated in FIG. 4. The distal ends 156 of two legs 144 attached to a common edge 128 are adjacent one another and proximate the longitudinal midpoint of their common edge 128. The distal ends 156 of the legs 144 provide a captivating means that prevents unintentional removal of the hinge 100 from the corresponding hinge slot 104. The U-shaped legs 144 permit the use of a thicker spring steel material without increasing the force required to install the hinge 100 in the corresponding hinge slot 104. As in the first embodiment, the thicker spring steel material reduces the chance of the hinge 100 cutting into the enclosure cover 116 by providing a wider surface (greater cross-section) to abut the material of the cover 116 at the slot 140 (FIG. 4).

Referring again to FIG. 4, it can be seen that the corresponding hinge slot 104 is actually two generally rectangular slots 160 each having an overall length and width dimensioned to slidably receive two of the U-shaped legs 144. A blocking bar 164 between the two slots 160 provides a blocking means which engage the edges 128 of the curved portion 116 to prevent the hinge 100 from being inserted too far into the corresponding hinge slot 104. The blocking bar 164 coincides with the space between the two adjacent distal ends 156 of legs 144 attached to a common edge 128.

Figure 6:
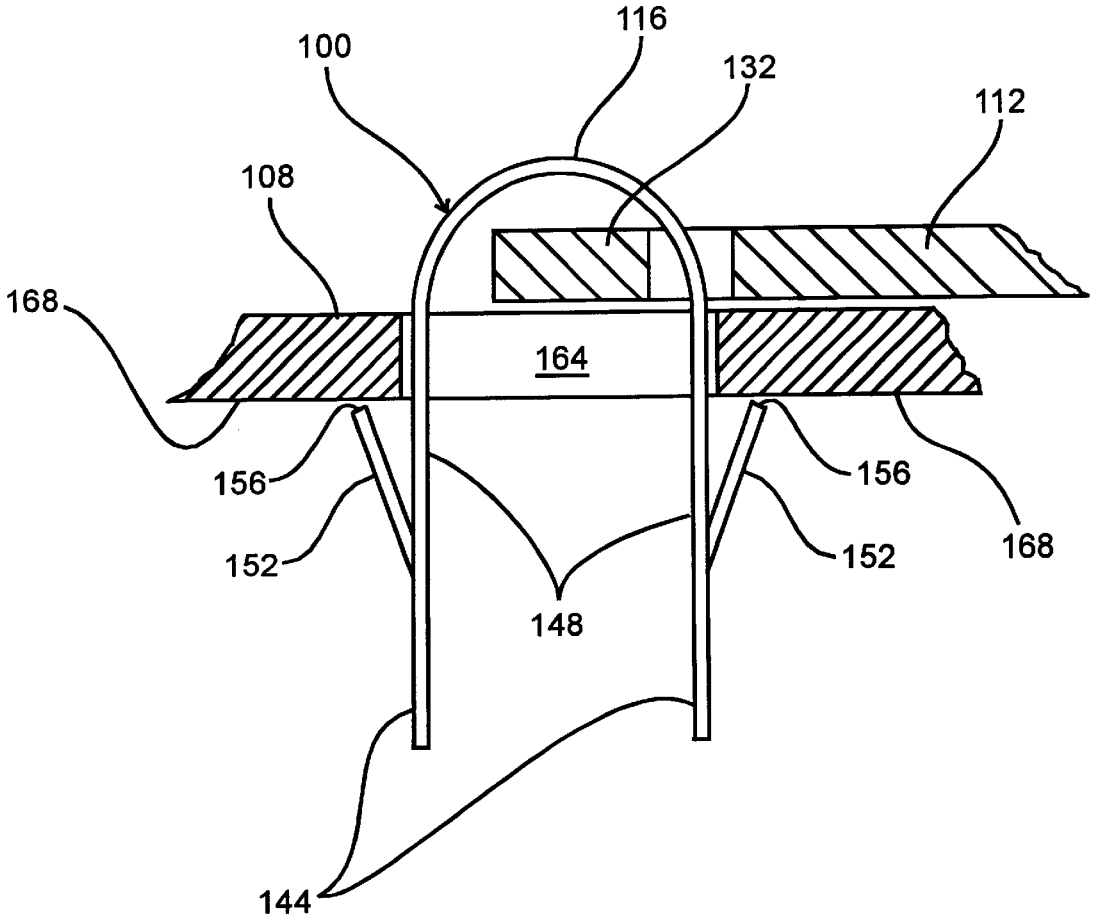
FIG. 6 is cross-sectional view taken along line 6—6 of FIG. 4 wherein the hinge is installed in the corresponding hinge slot.

FIG. 6 illustrates in cross-section, the relationship of the hinge 100 with respect to the corresponding hinge slot 104 in the enclosure 108 and the web 132 of the enclosure cover 116. The web 132 of the enclosure cover 116 is rotatably captured within the curved portion 116 of the hinge 100. The blocking bar 164 of the corresponding hinge slot 104 engage the edges 128 to prevent over insertion of the hinge 100 into the corresponding hinge slot 104. The distal ends 156 (captivating means) of the unattached portions 152 of legs 144 are positioned to engage an inside surface 168 of the enclosure 108 to prevent unintentional removed of the hinge 100 from the corresponding hinge slot 104.

What is claimed is:

1. A snap-in hinge for rotatably attaching an enclosure cover to an enclosure, said hinge comprising:

a hinge body having a generally curved portion defined by a first and a second end being generally parallel to one another and two generally parallel edges connecting said first and second ends, said hinge body including at least two legs extending from each of said parallel edges of said generally curved portion;

a portion of said enclosure defining at least one corresponding hinge slot for receiving said at least two extending legs of said hinge body, said corresponding hinge slot having a blocking means for preventing said snap-in hinge from being inserted too far into said corresponding hinge slot; and captivating means defined by said hinge body for captivating said snap in hinge in said corresponding hinge slot to prevent unintentional removal therefrom.

2. The snap-in hinge of claim 1 wherein said at least two legs extend generally perpendicularly from said two parallel edges at the intersection of said first and second ends of said curved portion of said hinge body such as to present a smooth continuous bearing surface to the enclosure cover.

3. The snap-in hinge of claim 2 wherein said at least two legs are generally U-shaped, each having an attached portion generally tangential to said curved portion of said hinge body and an unattached portion extending generally toward an associated one of said two parallel edges and at a slight outward angle with respect to said associated one of said two parallel edges such that a distal end of said unattached portion forming said captivating means is spaced apart slightly from said associated one of said two parallel edges of said curved portion in both X and Y dimensions.

4. The snap-in hinge of claim 3 wherein said captivating means of said unattached portions of said at least two legs extending from a common parallel edge are spaced apart from one another.

5. The snap-in hinge of claim 4 wherein said corresponding hinge slot includes two associated hinge slots spaced apart by said blocking means, one of said two associated hinge slots being dimensioned to receive two of said at least two legs associated with one of said first or second ends of said curved portion and the other of said two associated hinge slots being dimensioned to receive two of said at least two legs associated with the other of said first or second ends of said curved portion.

6. The snap-in hinge of claim 5 wherein said blocking means engages said two parallel edges of said hinge body at a point intermediate said spaced apart captivating means of said at least two legs attached to said common parallel edge thereby preventing over insertion of said snap-in hinge.

7. The snap-in hinge of claim 1 wherein each of said at least two legs are generally tangential to said curved portion of said hinge body and have distal ends spaced apart from said parallel edges.

8. The snap-in hinge of claim 7 wherein said at least two legs extending from a common parallel edge are connected by a rail extending between said distal ends, said rail being generally parallel to said common parallel edge.

9. The snap-in hinge of claim 8 wherein said captivating means is integrally formed from said rail.

10. The snap-in hinge of claim 9 wherein said captivating means extends from said rail in a direction generally toward said common parallel edge and at a slight outward angle with respect to said common parallel edge such that a distal end of said captivating means is spaced apart slightly from said common parallel edge of said curved portion in both X and Y dimensions.

11. The snap-in hinge of claim 10 wherein said captivating means extends from approximately the longitudinal midpoint of said rail.

12. The snap-in hinge of claim 1 wherein said captivating means is generally intermediate said at least two legs.

13. The snap-in hinge of claim 12 wherein said blocking means includes blocking tabs extending into said corresponding hinge slot for engagement with said two generally parallel edges of said curved portion of said snap-in hinge.

14. The snap-in hinge of claim 13 wherein said blocking tabs are positioned along the longitudinal sides of said corresponding hinge slot such as to engage said two parallel edges between said legs and said captivating means.

15. The snap-in hinge of claim 1 wherein each of said generally curved portion rotatably captivates a portion of the enclosure cover defining a hinge pin.

16. The snap-in hinge of claim 1 wherein said corresponding hinge slot includes two associated hinge slots space apart by said blocking means.

17. The snap-in hinge of claim 16 wherein one of said two associated hinge slots is dimensioned to receive two of said at least two legs associated with one of said first or second ends of said curved portion and the other of said two associated hinge slots is dimensioned to receive two of said at least two legs associated with the other of said first or second ends of said curved portion.

18. A snap-in hinge for rotatably attaching a cover to an enclosure, said hinge comprising:

a hinge body having a generally curved portion defined by a first and a second end being generally parallel to one another and two generally parallel edges connecting said first and second ends, said hinge body including at least two legs extending from each of said parallel edges of said generally curved portion, one said leg at each intersection with one of said first and second ends thus providing a smooth and continuous bearing surface for the enclosure cover;

a portion of said enclosure defining at least one corresponding hinge slot for receiving said at least two extending legs of said hinge body, said corresponding hinge slot having a blocking means engaging said two generally parallel edges for preventing said snap-in hinge from being inserted too far into said corresponding hinge slot; and captivating means defined by said hinge body for captivating said snap-in hinge in said corresponding hinge slot to prevent unintentional removal therefrom.

19. The snap-in hinge of claim 18 wherein said corresponding hinge slot includes two associated hinge slots space apart by said blocking means.

20. The snap-in hinge of claim 18 wherein said blocking means includes blocking tabs extending into said corresponding hinge slot from each of its longitudinal sides.

* * * * *